US010989036B2

(12) United States Patent
Yan et al.

(10) Patent No.: US 10,989,036 B2
(45) Date of Patent: Apr. 27, 2021

(54) DRILLING CASING AND METHOD OF PERFORMING FAST DRILLING AND COMPLETION OF LARGE-BOREHOLE MULTILATERAL WELL

(71) Applicant: CHINA UNIVERSITY OF PETROLEUM (EAST CHINA), Qingdao (CN)

(72) Inventors: Chuanliang Yan, Qingdao (CN); Xu Ren, Qingdao (CN); Yuanfang Cheng, Qingdao (CN); Wanqing Tian, Qingdao (CN); Yang Li, Qingdao (CN); Qingchao Li, Qingdao (CN); Jia Wei, Qingdao (CN); Benjian Song, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/757,569

(22) PCT Filed: Dec. 31, 2018

(86) PCT No.: PCT/CN2018/125987
§ 371 (c)(1),
(2) Date: Apr. 20, 2020

(87) PCT Pub. No.: WO2020/087762
PCT Pub. Date: May 7, 2020

(65) Prior Publication Data

US 2021/0025268 A1 Jan. 28, 2021

(30) Foreign Application Priority Data

Oct. 30, 2018 (CN) ..... 201811273919.2

(51) Int. Cl.
*E21B 23/01* (2006.01)
*E21B 43/10* (2006.01)
(Continued)

(52) U.S. Cl.
CPC ..... *E21B 43/305* (2013.01); *E21B 7/04* (2013.01); *E21B 43/084* (2013.01); *E21B 43/101* (2013.01)

(58) Field of Classification Search
CPC ..... E21B 23/01; E21B 43/103; E21B 43/305; E21B 7/04; E21B 43/08; E21B 43/084;
(Continued)

(56) References Cited

U.S. PATENT DOCUMENTS 6,516,506 B2 * 2/2003 Donnelly ..... E21B 29/10 29/451
6,857,476 B2 * 2/2005 Richards ..... E21B 43/04 166/227
(Continued)

FOREIGN PATENT DOCUMENTS

WO WO-2010069117 A1 * 6/2010 ..... E21B 43/08
WO WO-2018090890 A1 * 5/2018 ..... E21B 43/01
WO WO-2020087762 A1 * 5/2020

OTHER PUBLICATIONS

International search report dated Jul. 29, 2019 and English translation from corresponding application No. PCT/CN2018/125987.
(Continued)

*Primary Examiner* — Daniel P Stephenson
(74) *Attorney, Agent, or Firm* — Hauptman Ham, LLP

(57) ABSTRACT

A drilling casing includes a casing wall and several sand control apparatuses disposed on the casing wall in a spacing. Each sand control apparatus includes a sand control net, a sealing steel sheet and a sealing rubber plug. A plurality of mutually-paralleled sand control meshes are disposed on the
(Continued)

sand control net. The sand control mesh exactly faces the sealing steel sheet. The sand control net is connected with the sealing steel sheet through a steel pin. Further, a method of performing fast drilling and completion of a large-borehole multilateral well by the drilling casing includes forming a main borehole by drilling to a destination well depth at one time with a large-size drill bit, drilling a lateral borehole in a natural gas hydrate reservoir by using the drilling casing, and taking out the drill bit for completion. The method is applicable to various natural gas hydrate extraction manners.

8 Claims, 2 Drawing Sheets

(51) Int. Cl.
*E21B 43/30* (2006.01)
*E21B 7/04* (2006.01)
*E21B 43/08* (2006.01)

(58) Field of Classification Search
CPC ... E21B 43/088; B01D 29/111; B01D 29/216; Y10T 29/49604
See application file for complete search history.

(56) References Cited

U.S. PATENT DOCUMENTS 7,451,815 B2 * 11/2008 Hailey, Jr. ..... E21B 34/10 166/278
8,752,292 B2 * 6/2014 Mirtsch ..... B01D 33/52 29/896.62
8,875,784 B2 * 11/2014 Kuo ..... E21B 43/084 166/227
10,428,631 B2 * 10/2019 Noblett ..... E21B 43/108
10,613,691 B2 * 4/2020 Bruce ..... E21B 43/10
10,808,876 B2 * 10/2020 Gunnarsson ..... E21B 17/00
2003/0173075 A1 * 9/2003 Morvant ..... E21B 43/088 166/230
2004/0040723 A1 * 3/2004 Hovem ..... E21B 43/08 166/384
2005/0155772 A1 * 7/2005 Dusterhoft ..... E21B 43/103 166/381
2008/0023393 A1 * 1/2008 Blackburne, Jr. ..... E21B 43/084 210/455
2010/0051271 A1 * 3/2010 Gano ..... E21B 33/1208 166/278
2011/0036567 A1 * 2/2011 Holderman ..... E21B 43/103 166/228
2013/0341005 A1 * 12/2013 Bruce ..... E21B 43/08 166/207
2019/0049054 A1 * 2/2019 Gunnarsson ..... F16L 55/1656

OTHER PUBLICATIONS

Written Opinion dated Jul. 29, 2019 and English translation from corresponding application No. PCT/CN2018/125987.
First Search dated Nov. 28, 2019 and English translation from corresponding application No. CN 201811273919.2.
Decision to grant a patent dated Feb. 3, 2020 and English translation from corresponding application No. CN 201811273919.2.
Office Action dated Aug. 26, 2019 from corresponding application No. CN 201811273919.2.
Office Action dated Dec. 6, 2019 and English translation from corresponding application No. CN 201811273919.2.

* cited by examiner

DRILLING CASING AND METHOD OF PERFORMING FAST DRILLING AND COMPLETION OF LARGE-BOREHOLE MULTILATERAL WELL

RELATED APPLICATIONS

The present application is a National Phase of International Application Number PCT/CN2018/125987 filed Dec. 31, 2018 and claims priority to Chinese Application Number 2018112739192 filed Oct. 30, 2018.

TECHNICAL FIELD

The present disclosure relates to the technical field of natural gas hydrate extraction, and in particular to a new drilling casing and a method of performing fast drilling and completion of a large-borehole multilateral well by using the new drilling casing.

BACKGROUND

Natural gas hydrate is an ice-like solid formed by natural gas and water under the condition of a temperature and a pressure. The natural gas hydrate, commonly known as combustible ice, is mainly distributed in sediments at a depth of 0-1100 m under a seabed of a continental margin. The natural gas hydrate features wide distribution, a huge reserve and a high energy density, and thus has a broad development prospect as a potential energy capable of replacing a traditional fossil energy.

At present, the natural gas hydrate is mainly extracted by the following methods: a heat-transfer excitation extraction method, a depressurization extraction method, a chemical reagent injection method, a carbon dioxide displacement method, a solid-state fluidization extraction method, and the like. Due to complex formation of the natural gas hydrate deposit and complex geological conditions, mechanical properties of a hydrate-containing formation take change during the processes of well drilling, well completion and gas extraction performed with these methods, resulting in serious sand production problem. Further, during drilling or completion operations, collapse often occurs due to loose overburden rock layers, affecting progress of a work period. In this case, drilling and completion take longer work period, more time and more labor. At present, the above problem has to be solved urgently in order to perform safe and efficient extraction of the natural gas hydrate.

By searching existing technical patent literatures at home and abroad, it is found that there is no patent relating to well drilling and completion technology for completely solving the problem at present.

SUMMARY

To solve the above technical problem, the present disclosure provides a new drilling casing and a method of performing fast drilling and completion of a large-borehole multilateral well by using the new drilling casing.

To achieve the above object, the present disclosure adopts the following technical solution.

A new drilling casing includes a casing wall and several sand control apparatuses disposed on the casing wall in a spacing. Each sand control apparatus includes a sand control net, a sealing steel sheet and a sealing rubber plug, a plurality of mutually-paralleled sand control meshes are arranged on the sand control net, the sand control mesh exactly faces the sealing steel sheet, the sealing rubber plug is also disposed on contact surfaces of two end surfaces, i.e., left and right end surfaces, of the sealing steel sheet and the sand control net respectively, the sand control net and the sealing steel sheet are connected by a steel pin, and the steel pin is also connected in series with a steel ring on the sealing steel sheet through a thin steel wire.

Further, a design accuracy of the sand control mesh is $\omega=3.8\ d_{50}$, where $d_{50}$ refers to a median value of particle sizes of ultrafine sands in a natural gas hydrate reservoir.

A method of performing fast drilling and completion of a large-borehole multilateral well by using the above new drilling casing specifically includes the following steps.

At step (1), a large main borehole is drilled by drilling to a destination layer by using a large size drill bit, and then, a large main borehole casing of a reserved lateral hole is dropped into the large main borehole and then cement is injected to perform well cementing operations.

At step (2), a lateral borehole is drilled on the reserved lateral hole by using the new drilling casing, a thick steel wire rope protruding into one end of the reserved lateral hole is connected with the drill bit, and the new drilling casing is in a sealed state and serves as a drill rod for drilling.

At step (3), when drilling is performed to the destination layer, the drill bit is taken out by using the thick steel wire rope.

At step (4), the steel pin is pulled out by using the thin steel wire, the sealing steel sheet and the sealing rubber plug are pulled out together through the steel ring connected in series, and the sand control apparatus is started; at this time, the new drilling casing is changed from the drill rod to a casing with a sand control function and thus a completion operation of one lateral borehole is completed.

At step (5), steps (2) to (4) are repeated to complete the completion operations of other lateral boreholes.

Further, at step (1), when well cementing is performed after the large main borehole is drilled, it is only required to perform injection cementing for a rock layer without performing injection cementing for the natural gas hydrate reservoir.

Further, a reamer is also disposed at a connection position of the thick steel wire rope and the drill bit.

Further, at step (1), the reserved lateral hole on the casing of the large main borehole is 10 mm to 20 mm larger in radius than the reamer.

Further, the reserved lateral hole is at an included angle of 40°-50° with the large main borehole casing.

Further, at step (2), when the lateral borehole is drilled, the sand control net in the sand control apparatus is plugged by the sealing steel sheet and the sealing rubber plug and clamped by the steel pin, and the new drilling casing is in the sealed state.

The present disclosure has the following beneficial effects.

1. In the present disclosure, the manner of allowing the large main borehole to cooperate with a plurality of lateral boreholes is adopted, which increases a contact area with the natural gas hydrate reservoir. In this case a recovery rate is further increased, and a well pattern structure is optimized.

2. The multi-lateral borehole is drilled with the drilling technology of the new drilling casing, and the drilling process is synchronously completed with the casing running operation. The lateral borehole drilled by the casing is accompanied with the casing from beginning to end. Therefore, downhole accidents are reduced, and well control situations are improved. Since an inner diameter of the casing is larger than the drill rod, an annular area becomes smaller. Thus, hydraulic parameters are improved, and well drilling and completion are integrated. Thus, the pollution of the natural gas hydrate reservoir is avoided in a cementing process, and the work period of drilling and completion is shortened, thereby saving lots of labor and material costs.

3. The new drilling casing may serve not only as a drill rod in a drilling process, but also as a casing a sand control function in a completion process. The design accuracy of the sand control mesh on the new drilling casing is $\omega=3.8\ d_{50}$, which is obtained through a sand control experiment of an ultrafine sand reservoir of the natural gas hydrate. The mesh diameter can not only effectively prevent sand, and but also ensure the recovery rate.

In the present disclosure, the main borehole is formed by drilling to a destination well depth at one time with the large size drill bit, the lateral borehole is then drilled in the natural gas hydrate reservoir by using the new drilling casing, and then, the drill bit is taken out for completion. The drilling and completion method of the present disclosure is applicable to various natural gas hydrate extraction manners. The method can greatly increase production and the recovery rate of a hydrate well by integrating well drilling and completion in a shorter well completion period, thereby saving lots of labor and materials and ensuring effective sand control.

Numerals of the drawings are described as follows: 1. a seawater layer, 2. a rock layer, 3. a natural gas hydrate reservoir, 4. a large main borehole casing, 5. a large main borehole, 6. a lateral borehole, 7. a sand control apparatus, 7-1. a sand control mesh, 7-2. a sealing rubber plug, 7-3. a sealing steel sheet, 7-4. a steel pin, 8. a thick steel wire rope, 9. a reserved lateral hole, 10. a thin steel wire, 11. a reamer, and 12. a drill bit.

DETAILED DESCRIPTION OF THE EMBODIMENTS

The technical solutions of the examples of the present disclosure will be described clearly and fully below in combination with drawings in the examples of the present disclosure. It is apparent that the described examples are merely part of examples of the present disclosure rather than all examples. Other examples achieved by those of ordinary skill in the art based on the examples in the present disclosure without paying creative work shall all fall into the scope of protection of the present disclosure.

Figure 1:
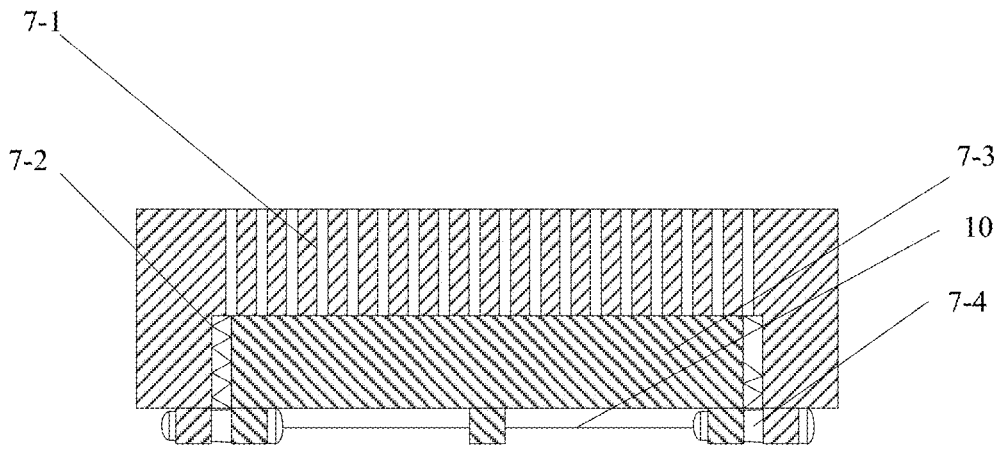
FIG. 1 is a schematic diagram illustrating a structure of a sand control apparatus of a casing according to an example of the present disclosure.

As shown in FIG. 1, a new drilling casing includes a casing wall and several sand control apparatuses 7 disposed on the casing wall in a spacing. Each sand control apparatus 7 includes a sand control net, a sealing steel sheet 7-3 and a sealing rubber plug 7-2, a plurality of mutually-paralleled sand control meshes 7-1 are disposed on the sand control net, the sand control mesh 7-1 exactly faces the sealing steel sheet 7-3, the sealing rubber plug 7-2 is also disposed on contact surfaces of two end surfaces, i.e., left and right end surfaces, of the sealing steel sheet 7-3 and the sand control net respectively, the sealing rubber plug 7-2 is used to seal the contact surface of the sealing steel sheet 7-3 and the sand control net, the sand control net and the sealing steel sheet 7-3 are connected by a steel pin 7-4, the steel pin 7-4 may realize connection and disconnection of the sealing steel sheet 7-3 and the sand control net, and the steel pin 7-4 is also connected in series with a steel ring on the sealing steel sheet 7-3 through a thin steel wire 10.

A design accuracy of the sand control mesh 7-1 is $\omega=3.8\ d_{50}$, where $d_{50}$ refers to a median value of particle sizes of ultrafine sand in a natural gas hydrate reservoir 3, and this data may be obtained according to a sand control experiment of an ultrafine sand reservoir of the natural gas hydrate.

Figure 2:
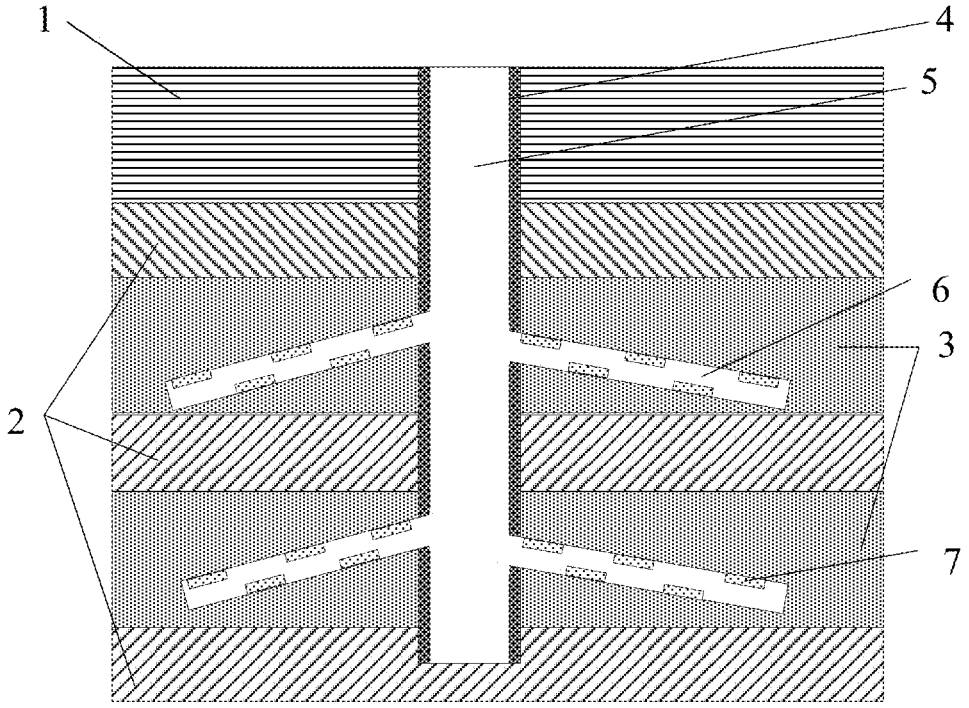
FIG. 2 is a schematic diagram illustrating a structure of a well according to an example of the present disclosure.

As shown in FIG. 2, a method of performing fast drilling and completion of a large-borehole multilateral well by using the above new drilling casing specifically includes the following steps.

At step (1), a large main borehole 5 is drilled by drilling to a destination layer by using a large size drill bit 12 and drilling into a seawater layer 1, a rock layer 2 and a natural gas hydrate reservoir 3, and then, a large main borehole casing 4 of a reserved lateral hole 9 is run into the large main borehole 5, and then cement is injected to perform well cementing operation. At this time, it is only required to perform injection cementing for the rock layer 2 without performing injection cementing for the natural gas hydrate reservoir 3.

Figure 3:
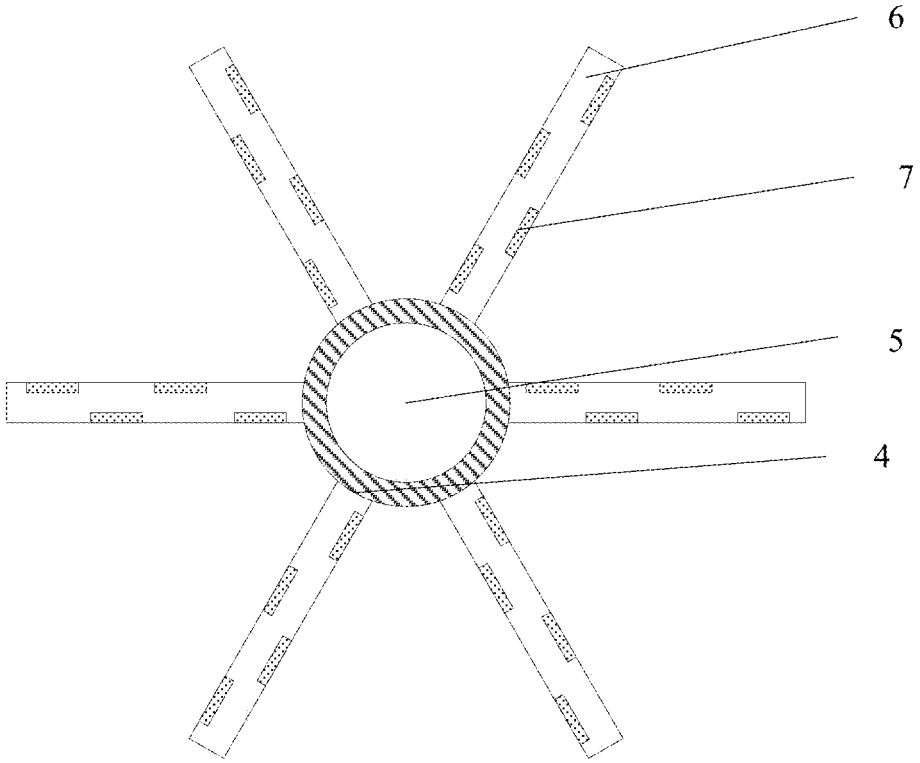
FIG. 3 is a structural diagram of a top view of FIG. 2 according to an example of the present disclosure.
Figure 4:
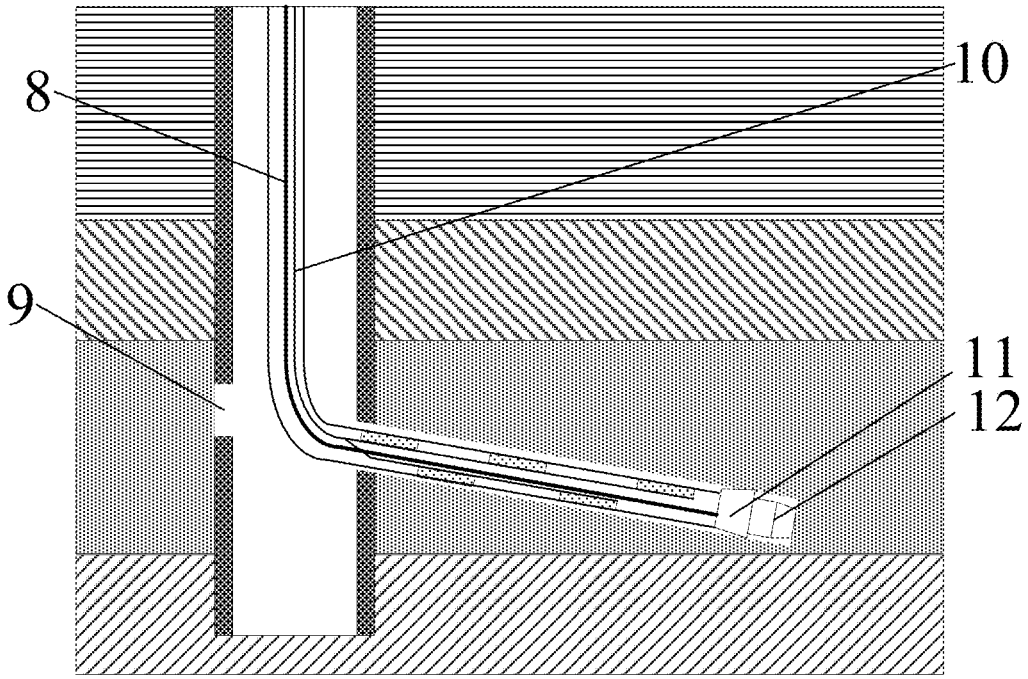
FIG. 4 is a schematic diagram illustrating a process of drilling a lateral borehole with a casing according to an example of the present disclosure.

At step (2), a lateral borehole 6 is drilled on the reserved lateral hole 9 by using the new drilling casing, each lateral borehole 6 is located in the natural gas hydrate reservoir 3, and the lateral boreholes 6 are distributed around the large main borehole 5, as shown in a structural top view of FIG. 3; a thick steel wire rope 8 protruding into one end of the reserved lateral hole 9 is connected with the drill bit 12, and a reamer 11 is also disposed at a connection position of the thick steel wire rope 8 and the drill bit 12; at this time, the sand control net in the sand control apparatus 7 is plugged by the sealing steel sheet 7-3 and the sealing rubber plug 7-2 and clamped by the steel pin 7-4, and the new drilling casing is in a sealed state and serves as a drill rod for drilling.

At step (3), when drilling is performed to the destination layer, the drill bit 12 is taken out by using the thick steel wire rope 8.

At step (4), the steel pin 7-4 is pulled out by using a thin steel wire 10, the sealing steel sheet 7-3 and the sealing rubber plug 7-2 are pulled out together through the steel ring connected in series, and the sand control apparatus 7 is started; at this time, the new drilling casing is changed from the drill rod to a casing with a sand control function and thus a completion operation of one lateral borehole 6 is completed.

At step (5), steps (2) to (4) are repeated to complete the completion operations of remaining lateral boreholes 6.

Particularly, at step (1), the reserved lateral hole 9 on the large main borehole casing 4 is 10 mm to 20 mm larger in radius than the reamer 11 to help the new drilling casing containing the reamer 11 to pass through the casing of the large main borehole 5 without being stuck when the lateral borehole 6 is drilled.

The reserved lateral hole 9 is at an included angle of 40°-50° with the large borehole casing 4. The included angle is reserved based on an inclination angle designed at a kickoff point by a technician when a horizontal well track is designed.

In the present disclosure, the manner of allowing the large main borehole 5 to cooperate with a plurality of lateral boreholes 6 is adopted, which increases the contact area with the natural gas hydrate reservoir. Thus, the recovery rate is further increased, and the well pattern structure is optimized.

The multi-lateral borehole 6 is drilled with the drilling technology of the new drilling casing, and the drilling process is synchronously completed with the casing running operation. The lateral borehole 6 drilled by the casing is accompanied with the casing from beginning to end. Therefore, downhole accidents are reduced, and well control situations are improved. Since an inner diameter of the casing is larger than the drill rod, an annular area becomes smaller. Thus, hydraulic parameters are improved, and well drilling and completion are integrated. Thus, the pollution of the natural gas hydrate reservoir is avoided in a cementing process, and the work period of drilling and completion is shortened, thereby saving lots of labor and material costs.

The new drilling casing may serve as a drill rod in a drilling process, and may also serve as a casing with a sand control function in a completion process. The design accuracy of the sand control mesh 7-1 on the new drilling casing is $\omega=3.8\ d_{50}$, which is obtained according to the sand control experiment of the ultrafine sand reservoir of the natural gas hydrate. The mesh diameter can not only effectively prevent sand, but also ensure the recovery rate.

Certainly, the foregoing descriptions are not intended to limit the present disclosure, and the present disclosure is also not limited to the above examples. Any changes, modifications, additions or substitutions made by persons skilled in the art within the spirit of the present disclosure shall also be encompassed in the scope of protection of the present disclosure.

The invention claimed is:

1. A drilling casing, comprising a casing wall and several sand control apparatuses disposed on the casing wall in a spacing, wherein each sand control apparatus comprises a sand control net, a sealing steel sheet and a sealing rubber plug, a plurality of mutually-paralleled sand control meshes are disposed on the sand control net, the sand control mesh exactly faces the sealing steel sheet, the sealing rubber plug is further disposed on contact surfaces of left and right end surfaces, of the sealing steel sheet and the sand control net respectively, the sand control net and the sealing steel sheet are connected by a steel pin, and the steel pin is further connected in series with a steel ring on the sealing steel sheet through a thin steel wire.

2. The drilling casing according to claim 1, wherein a design accuracy of the sand control mesh is $\omega=3.8d_{50}$, and $d_{50}$ refers to a median value of particle sizes of ultrafine sand in a natural gas hydrate reservoir.

3. A method of performing fast drilling and completion of a large-borehole multilateral well by using the drilling casing according to claim 1, comprising the following steps:

at step (1), drilling a large main borehole by drilling to a destination layer by using a large-size drill bit, and then, running a large main borehole casing of a reserved lateral hole into the large main borehole and then injecting cement to perform well cementing operations;

at step (2), drilling a lateral borehole on the reserved lateral hole by using the drilling casing, connecting a thick steel wire rope protruding into one end of the reserved lateral hole with the drill bit, wherein the drilling casing is in a sealed state and serves as a drill rod for drilling;

at step (3), when drilling is performed to the destination layer, taking out the drill bit by using the thick steel wire rope;

at step (4), pulling out the steel pin by using a thin steel wire, pulling out the sealing steel sheet and the sealing rubber plug together through the steel ring connected in series, and starting the sand control apparatus, wherein the drilling casing is changed from the drill rod to a casing with a sand control function at this time and a completion operation of one lateral borehole is completed; and at step (5), repeating steps (2) to (4) to complete the completion operations of the remaining lateral boreholes.

4. The method according to claim 3, wherein at step (1), when well cementing is performed after the large main borehole is drilled, the cementing is performed only for a rock layer without performing injection cementing for the natural gas hydrate reservoir.

5. The method according to claim 3, wherein a reamer is further disposed at a connection position of the thick steel wire rope and the drill bit.

6. The method according to claim 5, wherein at step (1), the reserved lateral hole on the large main borehole casing is 10 mm to 20 mm larger in radius than the reamer.

7. The method according to claim 6, wherein the reserved lateral hole is at an included angle of 40°-50° with the large main borehole casing.

8. The method according to claim 3, wherein at step (2), when the lateral borehole is drilled, the sand control net in the sand control apparatus is plugged by the sealing steel sheet and the sealing rubber plug and clamped by the steel pin, and the drilling casing is in the sealed state.

* * * * *